US007590370B2

(12) United States Patent
Yano

(10) Patent No.: US 7,590,370 B2
(45) Date of Patent: Sep. 15, 2009

(54) IMAGE FORMING APPARATUS HAVING OPENINGS AND A COVER

(75) Inventor: Hidetoshi Yano, Tokai (JP)

(73) Assignee: Brother Kogyo Kabushiki Kaisha (JP)

( * ) Notice: Subject to any disclaimer, the term of this patent is extended or adjusted under 35 U.S.C. 154(b) by 0 days.

(21) Appl. No.: 11/760,277

(22) Filed: Jun. 8, 2007

(65) Prior Publication Data

US 2007/0286638 A1 Dec. 13, 2007

(30) Foreign Application Priority Data

Jun. 9, 2006 (JP) ..... 2006-160985

(51) Int. Cl.
*G03G 15/00* (2006.01)
*G03G 21/16* (2006.01)

(52) U.S. Cl. ..... 399/110; 399/111

(58) Field of Classification Search ..... 399/110, 399/111, 114, 124, 125
See application file for complete search history.

(56) References Cited

U.S. PATENT DOCUMENTS

| | | | | |
|---|---|---|---|---|
| 5,561,499 | A * | 10/1996 | Setoriyama | 399/111 |
| 7,246,963 | B2 | 7/2007 | Nishimura | |
| 2004/0190934 | A1* | 9/2004 | Okabe | 399/111 |
| 2005/0244204 | A1* | 11/2005 | Seo et al. | 399/405 |
| 2006/0067726 | A1 | 3/2006 | Ito et al. | |
| 2006/0140669 | A1* | 6/2006 | Sato | 399/110 |
| 2006/0210302 | A1* | 9/2006 | Song | 399/111 |
| 2006/0291897 | A1* | 12/2006 | Ozawa | 399/110 |

FOREIGN PATENT DOCUMENTS

| | | |
|---|---|---|
| JP | 62-197626 | 12/1987 |
| JP | 5-5743 | 1/1993 |
| JP | 10-186775 | 7/1998 |
| JP | 2003-260849 | 9/2003 |
| JP | 2005-195704 | 7/2005 |
| JP | 2006-106021 | 4/2006 |

OTHER PUBLICATIONS

English translation of Japanese Office Action for corresponding application JP 2006-160985 with mailing date of Apr. 15, 2008.
Japanese Office Action in corresponding application No. 2006-160985 with mailing date of Apr. 15, 2008 and English translation thereof.
Corresponding English Language Abstract for JP10-186775, Jul. 21, 2005.
Corresponding English Language Abstract for JP2005-195704.
Corresponding English Language Abstract for JP2006-106021.

* cited by examiner

*Primary Examiner*—David M Gray
*Assistant Examiner*—Erika Villaluna
(74) *Attorney, Agent, or Firm*—Banner & Witcoff, Ltd.

(57) ABSTRACT

An image forming apparatus includes a development cartridge, a placement tray, an apparatus body, and a cover member. The development cartridge contains developer to be applied onto a recording sheet. The placement tray is configured so as to place recording sheets thereon. In the apparatus body, the development cartridge and the placement tray are detachably installed. The apparatus body includes a first opening and a second opening. Through the first opening, the development cartridge is attached/detached. Through the second opening, the placement tray is attached/detached. The cover member has a portion integrally and continuously extending over the first opening and the second opening so as to cover the first opening and the second opening.

13 Claims, 6 Drawing Sheets

IMAGE FORMING APPARATUS HAVING OPENINGS AND A COVER

CROSS-REFERENCE TO RELATED APPLICATIONS

This application claims the benefit of Japanese Patent Application No. 2006-160985 filed on Jun. 9, 2006 in the Japan Patent Office, the disclosure of which is incorporated herein by reference.

BACKGROUND

This invention relates to an image forming apparatus in which an image is formed on a recording sheet, such as a recording paper, by applying developer (for example, toner) thereon.

In an image forming apparatus (for example, a laser printer), various noise is generated. For example, mechanical noise is generated when movable members of such image forming apparatus are operated. Friction noise is generated when a recording paper is conveyed and friction is caused thereby. The noise generated inside of an image forming apparatus leaks outside through openings, such as attachment/detachment opening for a paper placement tray (a paper feed tray) on which sheets of recording paper are disposed.

In a conventional image forming apparatus, noise leak through a gap between a paper placement tray and an attachment/detachment opening is avoided by providing a sound insulating member made of a resilient member to a dust-proof cover of the paper placement tray.

In a general image forming apparatus, (for example, an electrographic image forming apparatus), in order to replenish expendable developer (such as toner), a development cartridge, in which developer is contained, is installed so as to be attachable/detachable with respect to the body of the apparatus.

An attachment/detachment opening provided for attaching/detaching the development cartridge to/from the apparatus body therethrough is closed by a front cover. On the other hand, an attachment/detachment opening provided for attaching/detaching a placement tray therethrough is closed by a cover portion integrated with the placement tray.

SUMMARY

However, for example, in an image forming apparatus wherein a placement tray and a development cartridge are installed in the apparatus body so as to be detachable approximately in a uniform direction, a gap is made between a front cover for the development cartridge and a cover portion of the placement tray. Such gap is made because an attachment/detachment opening for the placement tray and an attachment/detachment opening for the development cartridge are adjacently disposed, and the placement tray and the development cartridge are both detachably installed in the apparatus body. Consequently, noise leaks outside of the apparatus body through the gap.

In order to prevent such noise leak, a technique, such as the technique adopted in the above-described conventional image forming apparatus, is introduced. However, providing complete blockage of the gap is difficult by using the noise insulating portion made of a resilient member. Therefore, noise cannot be adequately inhibited from leaking outside of the body of an image forming apparatus.

In an image forming apparatus wherein a placement tray and a development cartridge are installed in the apparatus body so as to be detachable, noise is preferably inhibited from leaking outside of the apparatus body.

In one aspect of the present invention, an image forming apparatus may include a development cartridge, a placement tray, an apparatus body, and a cover member. The development cartridge contains developer to be applied onto a recording sheet. The placement tray is configured so as to place recording sheets thereon. In the apparatus body, the development cartridge and the placement tray are detachably installed. The apparatus body includes a first opening and a second opening. Through the first opening, the development cartridge is attached/detached. Through the second opening, the placement tray is attached/detached. The cover member has a portion integrally and continuously extending over the first opening and the second opening so as to cover the first opening and the second opening.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

In the following embodiments, the image forming apparatus according to the present invention is adopted to a so-called laser printer.

First Embodiment

1. Overall Structure of Laser Printer

Figure 1:
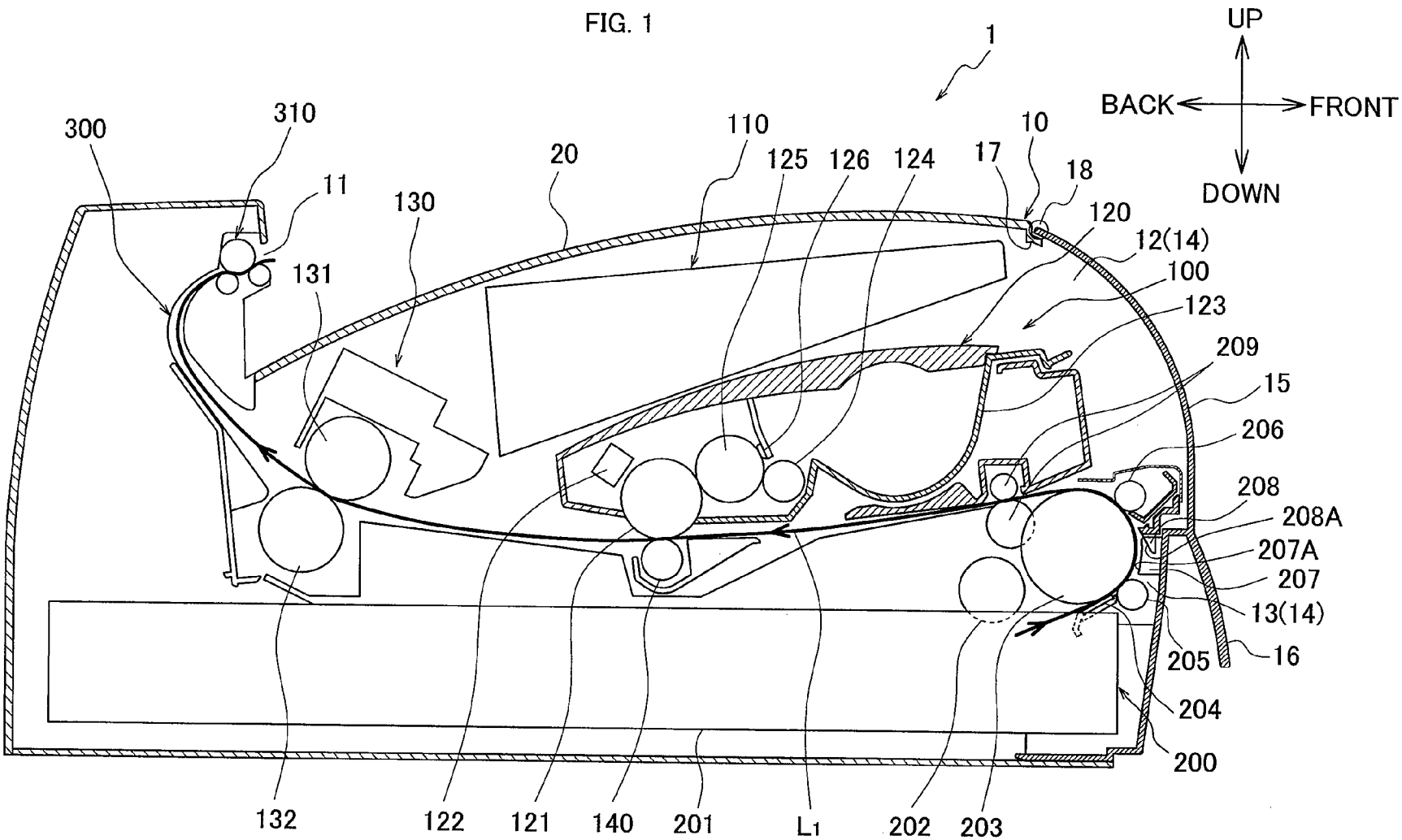
FIG. 1 is a sectional side view showing a substantial portion of a laser printer according to a first embodiment of the present invention.

As shown in FIG. 1, a laser printer 1 includes a housing 10 formed approximately in a box shape (a rectangular parallelepiped shape including a cubical shape). On the top surface of the housing 10, a paper discharge tray 20 is disposed wherein paper, on which image formation (printing) is performed, is discharged from the housing 10 and placed thereon. For the paper mentioned in the present embodiment, print paper or a recording sheet, such as a OHP sheet, are used.

2. Internal Structure of Laser Printer (See FIG. 1)

The housing 10 includes an image formation unit 100, a feeder unit 200, a discharge chute 300, and a discharge roller mechanism 310. The image formation unit 100 forms an image on paper. The feeder unit 200 supplies paper to the image formation unit 100. The discharge chute 300 guides paper, on which image formation is performed, toward a discharge unit 11. The discharge roller mechanism 310 discharges paper guided by the discharge chute 300, and straightens a curl of the paper.

2.1. Feeder Unit

The feeder unit 200 includes a paper placement tray (paper feed cassette) 201, a paper feed roller (pickup roller) 202, a separation roller 203, and a separation pad 204. The paper placement tray 201 is detachably installed in the lowest portion of the housing 10. The paper feed roller 202 is disposed above the front end portion of the paper placement tray 201, and conveys paper to the image formation unit 100. The separation roller 203 and the separation pad 204 separate paper to be conveyed by the paper feed roller 202 in a sheet by sheet manner.

On the paper placement tray 201, a plurality of sheets of paper, to be conveyed to the image formation unit 100, is placed in a stacked manner in an up-and-down direction. The paper placement tray 201 is attached/detected with respect to the housing 10 by being moved in a front-to-back direction (in the left-to-right direction in the drawing).

A first and a second pressure rollers 205, 206 are rotated while the rollers 205, 206 are in contact with a sheet of paper so as to press the sheet of paper against the separation roller 203. A sheet of paper, discharged upward from the paper placement tray 201, is conveyed so as to be winded around the outer periphery of the separation roller 203. The direction of the conveyance of the sheet of paper is thereby changed approximately 180 degrees by a turning unit. Then, the sheet of paper is conveyed toward the image formation unit 100.

Specifically, a sheet of paper discharged from the paper placement tray 201 is pressed against the separation roller 203 by the first pressure roller 205. The conveyance direction of the paper is changed approximately 90 degrees and directed upward. While the sheet of paper slidingly contacts with a guide surface 207A of a first guide member 207 formed in an inner wall side of a front cover 15 (to be described hereinafter), the sheet of paper is guided toward the second pressure roller 206.

The sheet of paper guided toward the second pressure roller 206 is guided by the second pressure roller 206 while the paper slidingly contacts with a guide surface 208A of a second guide member 208 disposed in the housing 10. The sheet of paper is pressed by the second pressure roller 206 against the upper side of the separation roller 203. The conveyance direction of the paper is changed toward the left side in the drawing. Then, the sheet of paper is conveyed toward the image formation unit 100.

That is, in the present embodiment, the conveyance direction of paper conveyed from the paper placement tray 201 is changed by a turning unit including the first and the second guide members 207, 208.

In the present embodiment, the first pressure roller 205 and the first guide member 207 are attached to the front cover 15. The second pressure roller 206 and the second guide member 208 are attached to the housing 10.

In the paper conveyance path formed between the paper placement tray 201 and the image formation unit 100, a pair of resist rollers 209 are disposed in vicinity of an entrance to the image formation unit 100. The pair of resist rollers 209 adjust conveyance condition of paper by applying predetermined conveyance resistance to a sheet of paper being conveyed.

2.2. Image Formation Unit

The image formation unit 100 includes a scanner unit 110, a development cartridge 120, and a fixation unit 130.

2.2.1. Scanner Unit

The scanner unit 110 is disposed in an uppermost portion of the housing 10, and forms a latent image on the surface of a photoreceptor drum 121 to be described later. Specifically, the scanner unit 110 includes a laser beam source (not shown), a polygon mirror (not shown), a fθ lens (not shown), and a reflection mirror (not shown).

Laser beam emitted from the laser beam source is deflected by the polygon mirror based on image data and passes through the fθ lens. The beam path of the laser beam is then returned by the reflection mirror. The beam path is bent downward such that laser beam is directed on the surface of the photoreceptor drum 121 so as to form a latent image thereon.

2.2.2. Development Cartridge

The development cartridge 120 is disposed above the paper placement tray 201 and below the scanner unit 110. The development cartridge 120 is located inside of the housing 10 so as to be detachable in the same direction as the detachment direction of the paper placement tray 201. The development cartridge 120 includes a photoreceptor drum 121, a charger 122, and a toner containing portion 123.

The photoreceptor drum 121 holds an image to be transferred on a sheet of paper. The cylindrical outer peripheral of the photoreceptor drum 121 is formed by positively charged photoreceptor layers, made of polycarbonate and the like. The charger 122 charges the surface of the photoreceptor drum 121. The charger 122 is disposed above and behind the photoreceptor drum 121 so as to face but not to contact the photoreceptor drum 121. A predetermined interval is provided between the charger 122 and the photoreceptor drum 121.

A scorotron type charger is adopted for the charger 122 according to the present embodiment wherein positive electric is charged approximately in a uniform manner on the surface of the photoreceptor drum 121 by using corona discharge.

The toner containing portion 123 contains toner (developer). Between the toner containing portion 123 and the photoreceptor drum 121, a toner supply roller 124 and a development roller 125 are disposed so as to supply toner, provided from the toner containing portion 123, to the photoreceptor drum 121.

Specifically, toner provided from the toner containing portion 123 is supplied toward the development roller 125 by rotation of the toner supply roller 124. Once the toner is supplied to the development roller 125, the toner is maintained on the surface of the development roller 125, and the thickness thereof is evenly adjusted to a predetermined thickness by a thickness restriction blade 126. Subsequently, the toner is supplied to the surface of the photoreceptor drum 121 exposed to laser beam emitted from the scanner unit 110.

In a position opposite to the photoreceptor drum 121 across a sheet of paper being conveyed, a transfer roller 140 is disposed. The transfer roller 140 is rotated in conjunction with the rotation of the photoreceptor drum 121. When a sheet of paper passes in vicinity of the photoreceptor drum 121, the transfer roller 140 transfers toner adhered on the surface of the photoreceptor drum 121 onto a printing surface of the sheet of paper. Toner is transferred by applying an electric charge opposite to the electric charge by which the photoreceptor drum 121 is charged (a negative electric charge, in the present embodiment) to the sheet of paper from a surface of the transfer roller 140 located in an opposite side of the printing surface of the sheet of paper.

As shown in FIG. 1, a contact point between the transfer roller 140 and the photoreceptor drum 121 is located below a contact point between the pair of resist rollers 209. That is, the contact point between the transfer roller 140 and the photoreceptor drum 121 is located more toward the paper placement tray 201 in comparison with the contact point between the pair of resist rollers 209. A conveyance path L1 extends from the side of the second pressure roller 206 and the resist rollers 209 to the side of the transfer roller 140. The conveyance path L1 is declined with respect to a horizontal direction such that the portion of the conveyance path L1 becomes closer to the paper placement tray 201 as the portion of the conveyance path L1 gets closer toward the side of the transfer roller 140 from the side of the resist rollers 209.

2.2.3. Fixation Unit

The fixation unit 130 is disposed in a downstream side of the photoreceptor drum 121 in the conveyance direction of paper. The fixation unit 130 heats and melts toner transferred onto a sheet of paper so as to fix the toner on the sheet of paper. Specifically, the fixation unit 130 includes a heat roller 131 and a pressure roller 132. The heat roller 131 is disposed in the printing surface side of a sheet of paper, and heats toner. The pressure roller 132 is disposed in an opposite side of the heat roller 131 across a sheet of paper, and presses a sheet of paper toward the heat roller 131.

2.3. Housing and Front Cover

As described above, the development cartridge 120 and the paper placement tray 201 are installed in the housing 10 so as to be detachable with respect to the housing 10 approximately in a uniform direction (the left-to-right direction in FIG. 1). The housing 10 is provided with a first opening 12 and a second opening 13. The development cartridge 120 is attached/detached through the first opening 12. The paper placement tray 201 is attached/detached through the second opening 13.

In the present embodiment, the first and the second openings 12, 13 are integrated so as to form one opening 14.

The opening 14 (the first and the second openings 12, 13) is closed by the front cover 15 continuously extending over the first and the second openings 12, 13. In the present embodiment, the front cover 15 is provided so as to be integrated with the paper placement tray 201.

The front cover 15 and the paper placement tray 201 according to the present embodiment are respectively and separately manufactured with resin, and combined by a mechanical fastener, such as a screw or a rivet, or engagement members respectively provided to the front cover 15 and the paper placement tray 201.

In the front side of the front cover 15 (in the right side in the drawing), a handle portion 16 is provided so as to pull the front cover 15 (the paper placement tray 201). The handle portion 16 and the front cover 15 are integrally formed by resin.

An end portion of the housing 10 adjacent to the opening 14, and an outer peripheral portion of the front cover 15 are respectively provided with overlapping portions 17, 18 so that the outer peripheral portion of the front cover 15 and the end portion of the housing 10 adjacent to the opening 14 overlap when the opening 14 (the fist and the second openings 12, 13) is closed by the front cover 15.

In the present embodiment, the overlapping portion 17 of the front cover 15 is formed into a step shape so as to be subsided toward inside of the housing 10. In this way, when the opening 14 is closed by the front cover 15, the outer surfaces of the housing 10 and the front cover 15 form a smooth surface without any bump formed therebetween.

The first and the second guide members 207, 208, which change the conveyance direction of paper conveyed from the paper placement tray 201, are disposed in a position so as to face the inner wall of the front cover 15, more specifically, in a "gap, formed between the front cover and the cover portion of the placement tray" as described earlier in the section "Background". In addition, in the present embodiment, the first and the second guide members 207, 208 are disposed in a position between the first and the second openings 12, 13.

Figure 2:
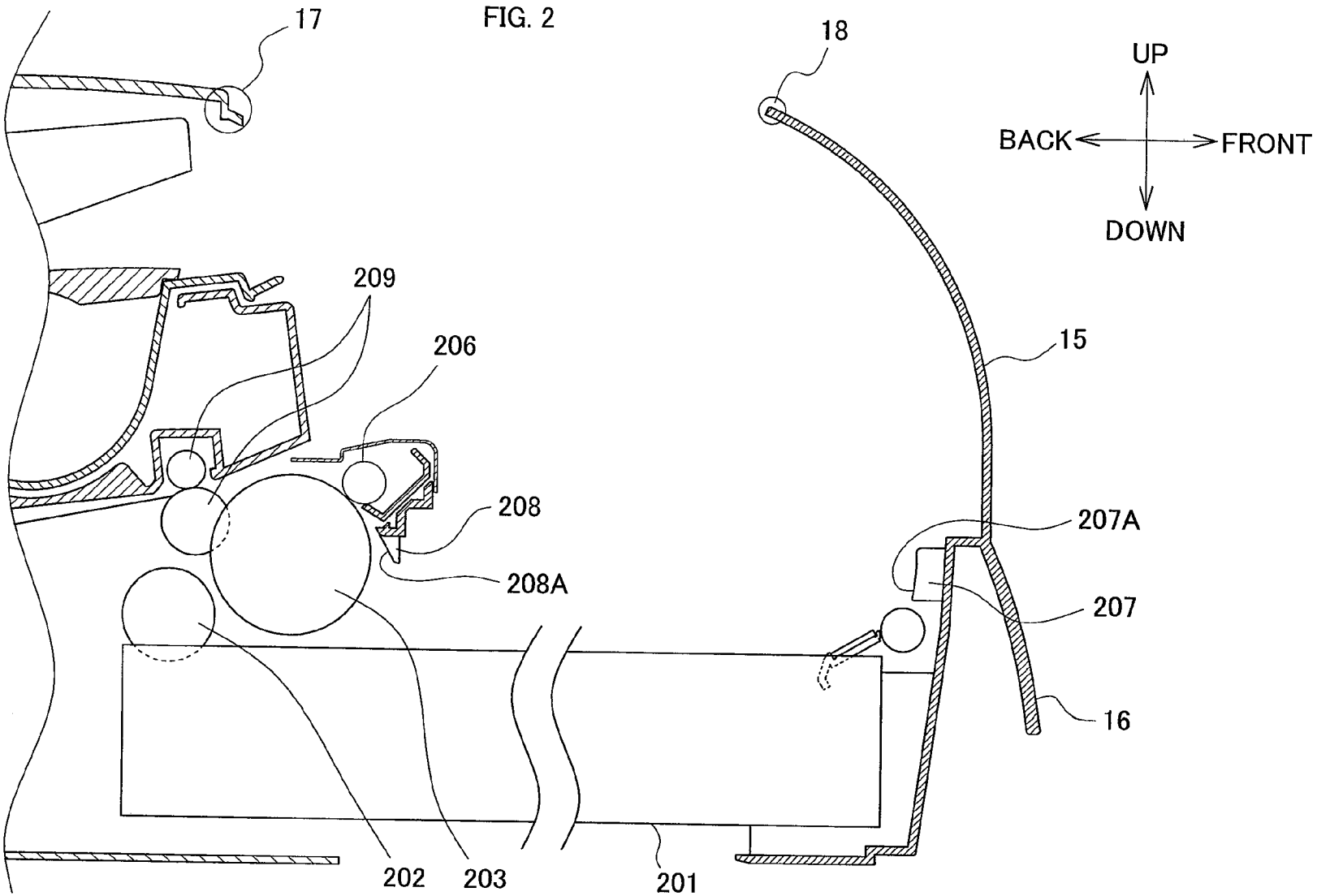
FIG. 2 is a sectional view showing a paper placement tray removed (pulled out) from a housing of the laser printer according to the first embodiment.
Figure 3:
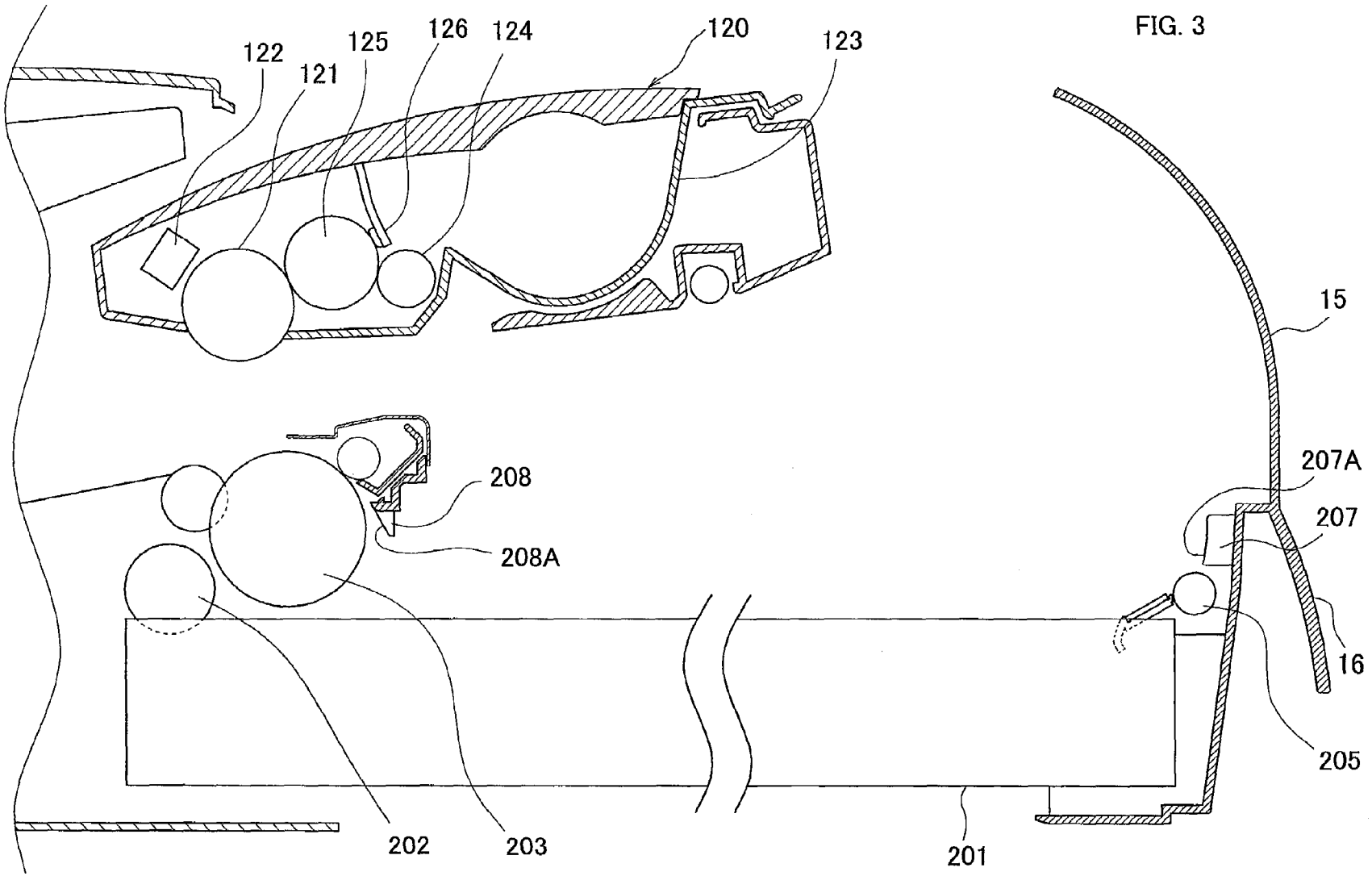
FIG. 3 is a sectional view showing a development cartridge removed from the housing of the laser printer according to the first embodiment.

In the above-described configuration, in order to remove the development cartridge 120 from the housing 10, as shown in FIG. 2, firstly, the paper placement tray 201 is pulled out so that the opening 14 (the first and the second openings 12, 13) becomes uncovered. Then, as shown in FIG. 3, the development cartridge 120 is pulled and taken out of the housing 10.

3. Feature of Laser Printer According to Present Embodiment

In the present embodiment, the front cover 15 is provided so as to extend over the first and the second openings 12, 13. This configuration enables the first opening 12 through which the development cartridge 120 is attached/detached, and the second opening 13 through which the paper placement tray 201 is attached/detached to be covered by the single front cover 15.

Therefore, "the gap between the front cover and the cover portion of the placement tray" described in the section "Background" does not exit in this configuration. As a result, noise can be effectively inhibited from leaking outside of the housing 10, and the noise generated by the laser printer 1 can be reduced.

The front cover 15 is integrally configured so as to extend over the first and the second openings 12, 13. This configuration enables to form a smooth surface without any gap or a bump in the front side of the laser printer 1, and to provide a good appearance to the laser printer 1.

The development cartridge 120 is removed from the housing 10 mainly when the amount of toner contained therein becomes small. On the other hand, the paper placement tray 201 is removed from the housing 10 so as to mainly replenish recording sheets.

Generally, the maximum amount of toner capable of being contained in the development cartridge 120 is larger than the amount of toner necessary for image formation performed on all the paper stored in the paper placement tray 201. Therefore, the number of times the paper placement tray 201 is attached/detached is much larger than the number of times the development cartridge 120 is attached/detached.

In a case wherein the front cover 15 and the paper placement tray 201 are separately formed, in order to remove the paper placement tray 201 from the housing 10, the front cover 15 needs to be opened (removed) prior to a removal of the paper placement tray 201 from the housing 10. Replenishment of paper is likely to become troublesome, if the paper placement tray 201, which is frequently attached/detached, and the front cover 15 are separately formed.

With respect to this issue, the front cover 15 is integrally formed with the paper placement tray 201 in the present embodiment. Replenishment of paper can be inhibited from being troublesome, since opening the front cover 15 and removing the paper placement tray 201 from the housing 10 can be simultaneously done.

In a portion of a laser printer, wherein the conveyance direction of paper is changed, friction force applied onto paper becomes large. Therefore, friction noise, which is one of the causes of noise generated in a laser printer, becomes large in this portion of a laser printer.

Concerning this problem, in the present embodiment, the first and the second guide members 207, 208, which change the conveyance direction of paper, are disposed in a position so as to face the inner wall of the front cover 15. The front cover 15 is disposed in vicinity of the first and the second guide members 207, 208 where large friction noise is generated. In the present embodiment, the vicinity of the noise source can be covered by the front cover 15. Therefore, noise can be effectively inhibited from leaking outside of the housing 10.

Moreover, the laser printer 1 (housing 10) according to the present embodiment is provided with the overlapping portions 17, 18 so that the outer peripheral of the front cover 15 and the end portion of the housing 10 in vicinity of the opening 14 overlap when the opening 14 is closed by the front cover 15. Therefore, noise leakage from inside of the laser printer 1 (housing 10) to outside thereof can be reliably inhibited.

Furthermore, in the present embodiment, the portion of the conveyance path L1 extending from the resist rollers 209 to the transfer roller 140 is declined with respect to the horizontal direction such that the portion of the conveyance path L1 becomes closer to the paper placement tray 201 as the portion of the conveyance path L1 gets closer toward the side of the transfer roller 140 from the side of the resist rollers 209. Therefore, the distance between the transfer roller 140 and the paper placement tray 201 can be reduced, and the size of the laser printer 1 in the up-and-down direction can be reduced.

In the laser printer 1 according to the present embodiment, a sheet of paper sent from the paper placement tray 201 is conveyed in a distinctly curved state. Large noise is likely to be caused inside of the housing 10 (laser printer 1).

However, the laser printer 1 according to the present embodiment is configured such that noise can be sufficiently inhibited from leaking from the housing 10, and that noise generated in vicinity of the first and the second guide members 207, 208 can be reduced. Therefore, noise of the laser printer 1 can be reduced, even if paper is conveyed in a distinctly curved state.

As a result, in the present embodiment, the size of the laser printer 1 in the up-and-down direction can be reduced, and noise of the laser printer 1 can be also reduced.

Second Embodiment

In the first embodiment, the first pressure roller 205 and the first guide member 207 are attached to the front cover 15, and the second pressure roller 206 and the second guide member 208 are attached to the housing 10. In the present embodiment, all of the first and the second pressure rollers 205, 206 and the first and the second guide members 207, 208 are attached to the front cover 15.

Figure 4:
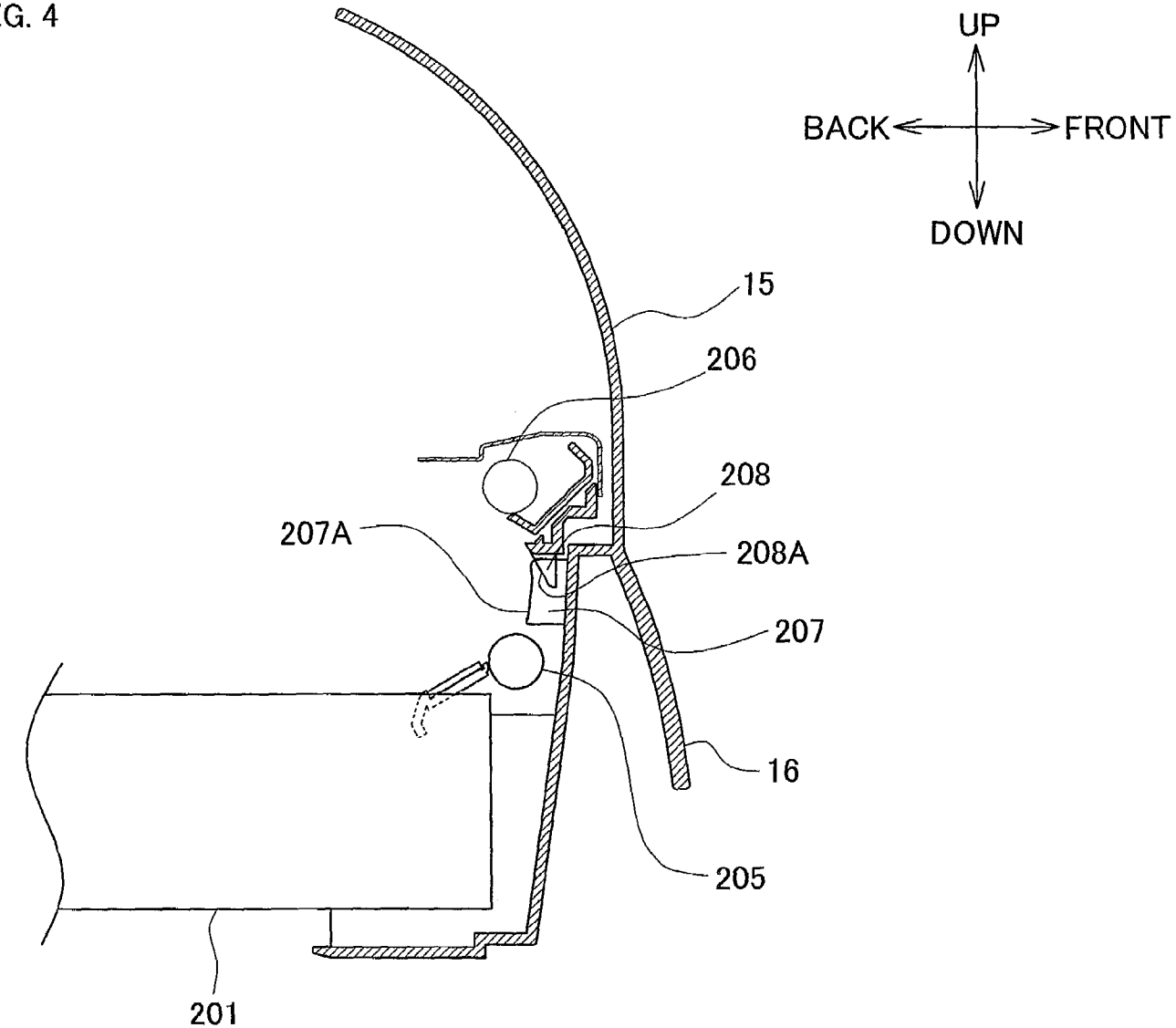
FIG. 4 is a sectional view showing a paper placement tray pulled out from a laser printer according to a second embodiment of the present invention.

That is, in the present embodiment, as shown in FIG. 4, all of the first and the second pressure rollers 205, 206 and the first and the second guide members 207, 208 are disposed in a position so as to face the inner wall of the front cover 15.

The following describes the feature of the laser printer 1 according to the present embodiment.

In a case wherein a distinct bump exists between the first and the second guide members 207, 208, a trailing end of a conveyed paper is flipped by the bump and hits the second guide member 208. When a conveyed paper hits the second guide member 208, loud noise (hitting noise) is generated.

The portion of a conveyed paper more distinctly curved hits the second guide member 208 faster, and makes loud noise (hitting noise). That is, noise is more likely to be generated in a portion of the laser printer 1 wherein the first and the second guide members 207, 208 are disposed.

With respect to this issue, both of the first and the second guide members 207, 208 are fixed to the front cover 15 in the present embodiment. Therefore, a bump formed between the first and the second guide members 207, 208 can be configured small.

In a case, as in the first embodiment, wherein the first guide member 207 is disposed in the side of the front cover 15 (the paper placement tray 201), and the second guide member 208 is disposed in the side of the housing 10, a bump formed between the first and the second guide members 207, 208 is likely to become large, because variation of the size of the front cover 15 with respect to the housing 10 is added to the size of the bump.

In order to keep such bump small in the above-described configuration, variations caused in the sizes of the front cover 15 and the housing 10 themselves, and size variation caused in attaching the front cover 15 to the housing 10 need to be kept small. For this purpose, the number of manufacturing steps of the laser printer 1 is likely to be increased.

Considering this issue, both of the first and the second guide members 207, 208 are fixed to the front cover 15 in the present embodiment. Therefore, the variations caused in the size of the front cover 15 with respect to the housing 10, and the size variation caused in attaching the front cover 15 to the housing 10 are not added to the size of the bump formed between the first and the second guide members 207, 208.

Since the bump formed between the first and the second guide members 207, 208 can be small, noise generated by the bump can be reduced.

Third Embodiment

Figure 5:
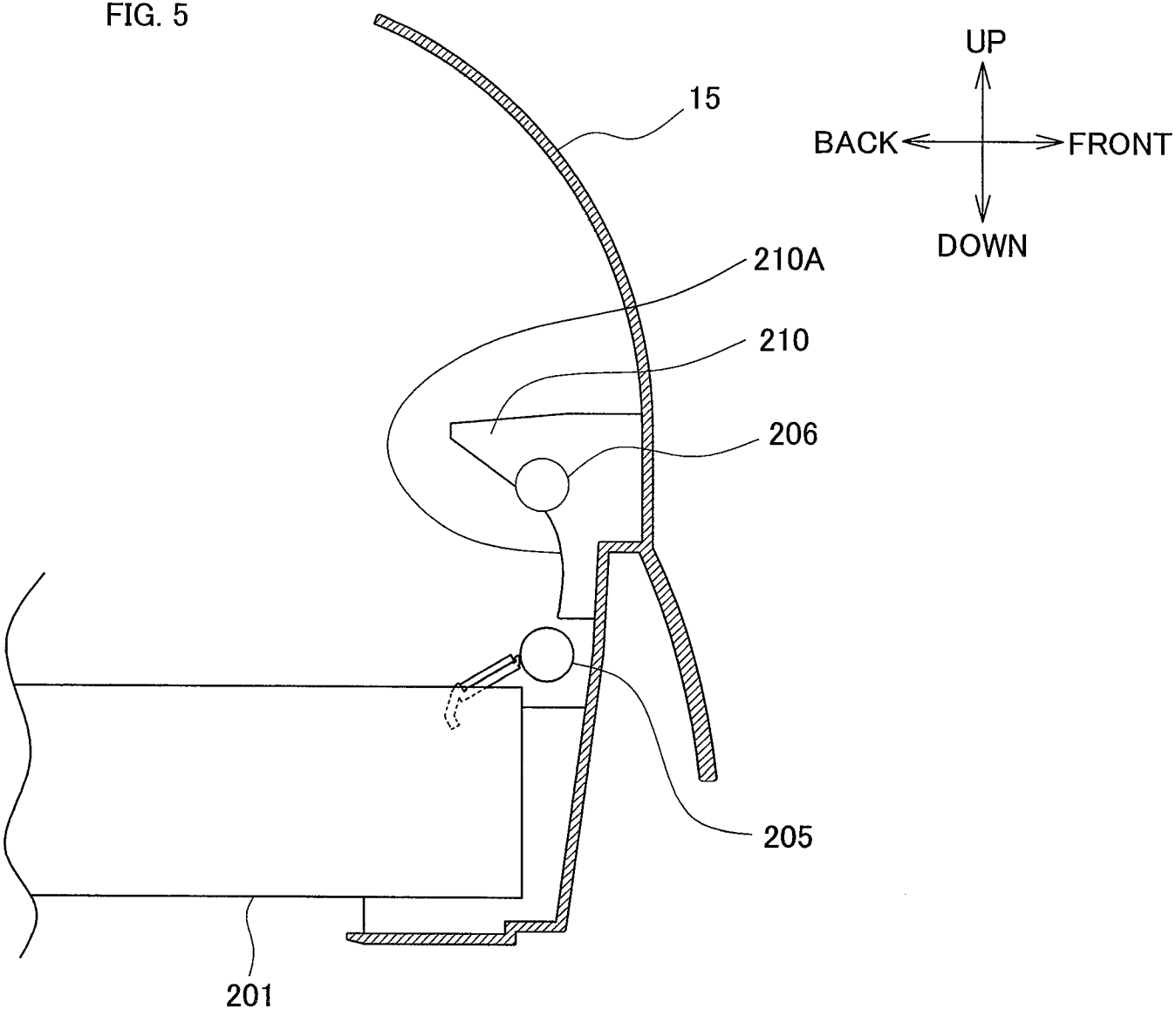
FIG. 5 is an enlarged sectional view showing a guide member of a laser printer according to a third embodiment of the present invention.

In the second embodiment, the first and the second guide members 207, 208 are individual members. In the present embodiment, as shown in FIG. 5, the first and the second guide members 207, 208 are integrally formed as a single guide member 210. The guide member 210 is formed into an arc shape having a smooth guide surface 210A which slidingly contacts a sheet of paper, and extends along the conveyance direction of paper.

Therefore, the guide member 210 is configured without any bump in the present embodiment. As a result, noise generated in vicinity of the guide member 210 can be further reduced, and noise of the laser printer 1 can be further reduced.

Fourth Embodiment

Figure 6:
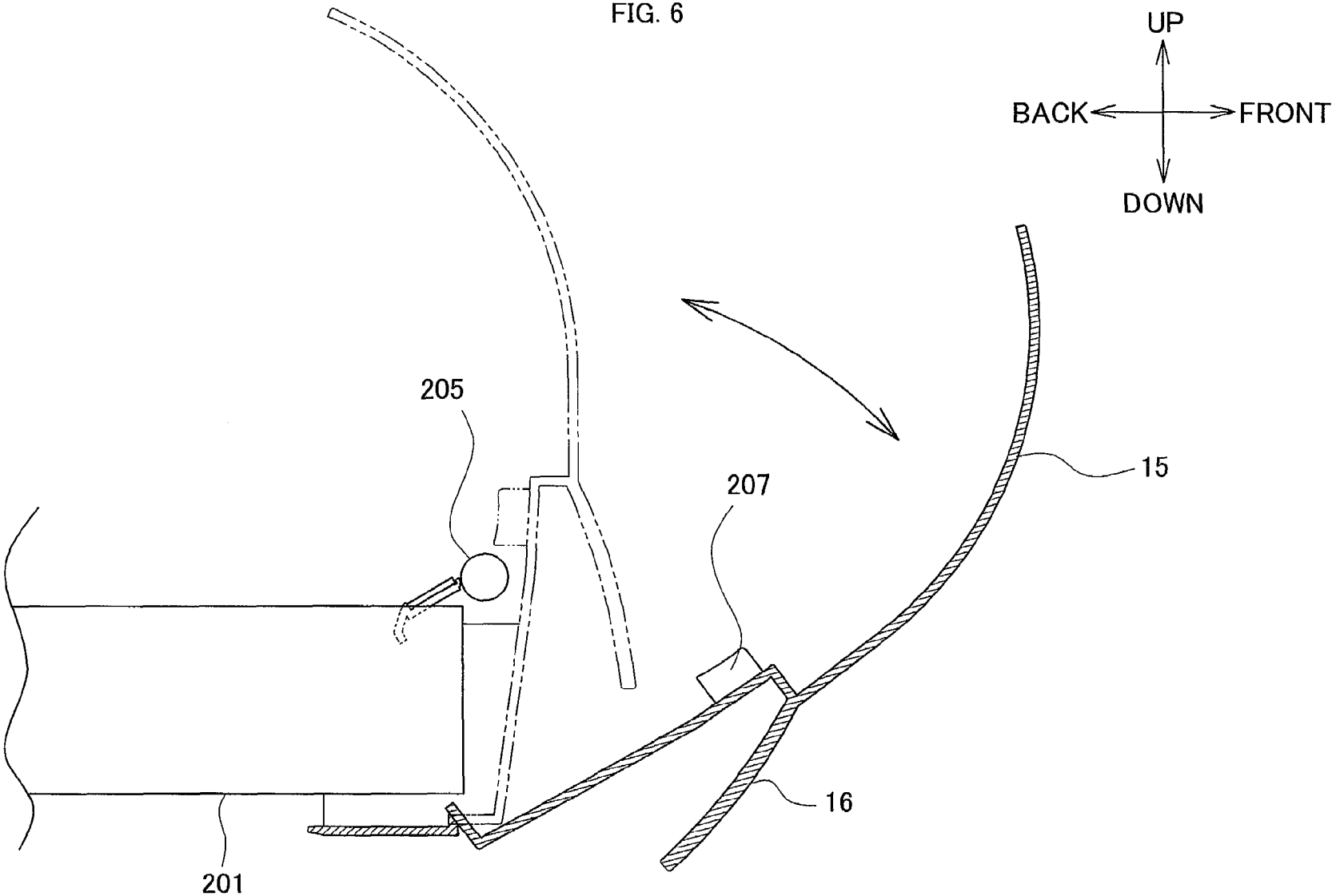
FIG. 6 is an enlarged sectional view showing a characterizing portion of a laser printer according to a fourth embodiment of the present invention.

In the above-described embodiments, the front cover 15 is integrated with the front end portion of the paper placement tray 201, and does not have mobility with respect to the paper placement tray 201. In the present embodiment, as shown in FIG. 6, the front cover 15 is rotatably attached to the paper placement tray 201 by a hinge mechanism (not shown).

Therefore, in the present embodiment, when the front cover 15 is inclined so as to rotate with respect to the paper placement tray 201 for replenishing (placing) paper on the paper placement tray 201, the front cover 15 can be inhibited from interrupting the replenishment. Paper can be easily replenished on the paper placement tray 201.

Moreover, since the front cover 15 is rotatably attached to the paper placement tray 201 in the present embodiment, the first opening 12 can be opened simply by opening the front cover 15 without pulling out the paper placement tray 201 in order to attach/detach the development cartridge 120 to/from the housing 10.

As a result, operationability in attaching/detaching the development cartridge 120 can be improved, because the development cartridge 120 can be attached/detached while the paper placement tray 201 is installed in the housing 10 (laser printer 1).

Although FIG. 6 shows an example wherein the present embodiment is applied to the configuration according to the first embodiment, the application of the present embodiment is not limited to this example. The present embodiment may be applied to the configuration according to the second or the third embodiment.

Other Embodiment

In the above-described embodiments, the first and the second openings 12, 13 constitute the single opening 14. The present invention is not limited to the above-described configuration. The first and the second openings 12, 13 may be individually provided.

Moreover, in the above-described embodiments, the front cover 15 is provided to the paper placement tray 201. However, the present invention is not limited to this configuration. The front cover 15 can be, for example, rotatably attached to the housing 10, or can be detachably attached to the laser printer 1 (housing 10).

Furthermore, the overlapping portions 17, 18, by which the outer peripheral of the front cover 15 and the end portion of the housing 10 adjacent to the opening 14 overlap, are provided in the above-described embodiments. The present invention is not limited to this configuration. The outer peripheral of the front cover 15 and the end portion of the housing 10 adjacent to the opening 14 may be formed so as to abut each other, so that the overlapping portions 17, 18 may be omitted.

Still furthermore, although the overlapping portion 17 of the housing 10 is provided with a step portion in the above-described embodiments, the present invention is not limited to this configuration. The step portion of the overlapping portion 17 of the housing 10 may be omitted, or the step portion may be provided to the overlapping portion 18 of the front cover 15.

Moreover, in the above-described embodiments (for example, in the first embodiment), the first guide member 207 is disposed in the side of the front cover 15. However, the present invention is not limited to this configuration. Both of the first and the second guide members 207, 208 may be, for example, disposed in the side of the housing 10.

Additionally, the present invention is applied to a monochrome laser printer in the above-described embodiments. However, the application of the present invention is not limited to this application. The present invention may be applied to a color laser printer, a monochrome or a color copier.

Moreover, the present invention is not only applicable to a laser printer, but may also be applicable to a so-called LED printer. In a LED printer, a photosensitive layer surface of a photoreceptor drum is exposed to light by a plurality of LEDs disposed in parallel along a rotational shaft of the photoreceptor drum. The present invention may be furthermore applicable, for example, to other types of image forming apparatus, such as a multifunction apparatus and so on.

Furthermore, the above-described embodiments describe examples wherein toner (for example, powdery toner) is used as the developer. However, the present invention may be also applicable to an image forming apparatus wherein liquid developer is used as the developer.

Although specific embodiments have been illustrated and described herein, it is to be understood that the above description is intended to be illustrative, and not restrictive. Combinations of the above embodiments and other embodiments will be apparent to those of skilled in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. An image forming apparatus comprising:

a development cartridge that contains developer to be applied onto a recording sheet;

a placement tray configured so as to place recording sheets thereon;

an apparatus body in which the development cartridge and the placement tray are detachably installed, the body including:

a first opening through which the development cartridge is attached/detached; and a second opening through which the placement tray is attached/detached; and a cover member having a portion integrally and continuously extending over the first opening and the second opening so as to completely cover the first opening and the second opening, wherein the portion of the cover member that integrally and continuously extends over the first opening and the second opening rotates relative to the placement tray.

2. The image forming apparatus as set forth in claim 1 wherein the development cartridge and the placement tray are installed inside of the apparatus body so as to be detachable approximately in a uniform direction.

3. The image forming apparatus as set forth in claim 1 further comprising a transfer roller provided separately from the development cartridge so as to apply the developer on a recording sheet, wherein, in the apparatus body, a recording sheet placed on the placement tray is conveyed toward the transfer roller.

4. The image forming apparatus as set forth in claim 1 wherein the apparatus body is provided with an overlapping portion that overlaps with an outer periphery of the cover member, when the first opening and the second opening are closed by the cover member.

5. The image forming apparatus as set forth in claim 1 further comprising a turning unit that contacts a recording sheet conveyed from the placement tray, and changes a conveyance direction of the recording sheet.

6. The image forming apparatus as set forth in claim 5 wherein the turning unit is disposed in a position inside of the apparatus body which is closed by the cover member.

7. The image forming apparatus as set forth in claim 6 wherein the turning unit is disposed in a position so as to face an inner wall of the cover member.

8. The image forming apparatus as set forth in claim 6 wherein the turning unit is disposed in a position between the first opening and the second opening in the position inside of the apparatus body which is closed by the cover member.

9. The image forming apparatus as set forth in claim 6 wherein the turning unit is fixed to the cover member.

10. The image forming apparatus as set forth in claim 6 wherein a contact portion of the turning unit which contacts a recording sheet is formed in a shape having a continuous smooth surface along the conveyance direction of the recording sheet.

11. The image forming apparatus as set forth in claim 6 further comprising a transfer roller provided separately from the development cartridge so as to apply the developer on a recording sheet, wherein, in the apparatus body, a recording sheet placed on the placement tray is conveyed toward the transfer roller, wherein the development cartridge and the transfer roller are disposed above the placement tray, and wherein the turning unit changes the conveyance direction of the recording sheet conveyed from the placement tray approximately 180 degrees, and conveys the recording sheet toward the transfer roller.

12. The image forming apparatus as set forth in claim 11 wherein a conveyance path extending from the turning unit to the transfer roller is formed such that the conveyance path is declined with respect to a horizontal direction so as to approach the placement tray as the conveyance path proceeds to the transfer roller.

13. The image forming apparatus as set forth in claim 1, wherein the image forming apparatus is an electrographic image forming apparatus that forms an image on a recording sheet by transferring toner onto the recording sheet, and wherein the toner is contained in the development cartridge.

* * * * *